US007823743B2

(12) United States Patent
McKahan et al.

(10) Patent No.: US 7,823,743 B2
(45) Date of Patent: Nov. 2, 2010

(54) FOOD CONTAINER AND METHOD OF MANUFACTURE

(75) Inventors: William D. McKahan, Kansas City, MO (US); Elizabeth A. Romano, Lawrence, KS (US)

(73) Assignee: Huhtamaki, Inc., De Soto, KS (US)

( * ) Notice: Subject to any disclaimer, the term of this patent is extended or adjusted under 35 U.S.C. 154(b) by 879 days.

(21) Appl. No.: 11/550,484

(22) Filed: Oct. 18, 2006

(65) Prior Publication Data

US 2008/0093366 A1 Apr. 24, 2008

(51) Int. Cl.
*B65D 1/36* (2006.01)
*B65D 51/18* (2006.01)
*B65D 51/24* (2006.01)

(52) U.S. Cl. ..... 220/521; 220/254.1; 220/212

(58) Field of Classification Search ..... 220/521, 220/522, 574.1, 254.7, 254.1, 735, 212, 500, 220/694, 200, 574; 215/391, 390, 228, DIG. 5, 215/200; D9/717, 715, 436, 445, 444, 435; 206/564, 562; 229/404, 401, 400
See application file for complete search history.

(56) References Cited

U.S. PATENT DOCUMENTS

| | | | | | |
|---|---|---|---|---|---|
| 2,433,926 | A | | 1/1948 | Sayre | |
| 2,661,889 | A | * | 12/1953 | Phinney | 229/404 |
| 3,208,625 | A | | 9/1965 | Trabacchi | |
| 3,334,778 | A | | 8/1967 | Saunders | |
| 3,550,805 | A | | 12/1970 | Leonforte | |
| 3,624,787 | A | | 11/1971 | Newman | |
| 3,679,093 | A | | 7/1972 | Chang | |
| 3,722,779 | A | | 3/1973 | Chang | |
| 3,955,742 | A | | 5/1976 | Marshall et al. | |
| 4,036,398 | A | | 7/1977 | Hoogvelt et al. | |
| 4,218,010 | A | | 8/1980 | Ruff | |
| 4,300,700 | A | * | 11/1981 | Chang | 220/521 |
| 4,453,666 | A | * | 6/1984 | Gordon | 229/102 |
| 5,115,930 | A | * | 5/1992 | Lohrman et al. | 215/227 |
| 5,251,758 | A | | 10/1993 | Kolacek | |
| 5,415,309 | A | | 5/1995 | Wang | |
| 5,443,174 | A | | 8/1995 | Bauer | |
| 5,695,084 | A | | 12/1997 | Chmela et al. | |
| 5,705,212 | A | | 1/1998 | Atkinson | |
| 5,992,667 | A | | 11/1999 | Huang | |
| 6,003,710 | A | | 12/1999 | Huang | |
| 6,058,682 | A | | 5/2000 | Pajak et al. | |
| 6,116,450 | A | | 9/2000 | Huang | |
| 6,604,646 | B2 | | 8/2003 | Torniainen et al. | |
| 6,766,902 | B1 | | 7/2004 | Hartelius | |
| 6,840,397 | B1 | | 1/2005 | Rosenberg | |
| 2003/0230482 | A1 | | 12/2003 | Whitmore et al. | |

* cited by examiner

*Primary Examiner*—Anthony Stashick
*Assistant Examiner*—Robert J Hicks
(74) *Attorney, Agent, or Firm*—Husch Blackwell LLP

(57) ABSTRACT

A food container is provided having a receptacle with an open mouth. A lid is provided. The lid includes an end cap, an eating utensil and a cover. The eating utensil is positioned between the cover and a wall portion of the end cap. The cover is removably secured to the end cap and upon removal provides access to the eating utensil. Upon removal of the end cap from the container bottom, the contents are exposed and the eating utensil may be used to consume the contents of the container.

17 Claims, 4 Drawing Sheets

FOOD CONTAINER AND METHOD OF MANUFACTURE

BACKGROUND OF THE INVENTION

Food containers with removable lids are well known in the industry. Such containers will typically comprise a container bottom or receptacle having a cavity therein for the storage of a food product. The container receptacle will typically have a sidewall, a bottom wall and an upwardly opening top defined by a peripheral lip. A lid is removably mounted to the receptacle at the open end to selectively close the container opening. The lid may be semi-permanently secured to the receptacle or may be easily removably mounted to the receptacle as for example a friction fit or held in place by a snap lock fit. For some food products, a membrane closure can also be provided for hermetically sealing the container bottom and to provide tamper evidence should the container be opened prior to sale or even after sale. Such containers may be sold as singles or in a multi-pack version. An overwrap may also be provided for the container, particularly those containers which have the lid easily removable, to help prevent tampering and accidental lid removal. Containers with easily removable lids are used for ice cream, yogurt, margarine, sour cream, dips, sauces and the like. In such case, the container bottom or receptacle is made from a material and by a method compatible with the product to be stored. Examples of such receptacles include a helically wrapped paperboard, a side seamed wrapped construction, a polymeric container made by injection molding, thermoforming or vacuum forming. The lids may also be thermoformed or injection molded or may also be made out of paperboard or the like. Such containers are well known in the industry.

With a single serve container, it is desirable to provide a container that is both easily opened and is convenient for the consumer to consume the contents informally. However, consumers typically do not have an eating utensil or implement available unless they are at home or at work where such utensils are readily available. When done, it would be desirable for the consumer to properly dispose of the entire container including the container bottom and lid, and the eating utensil. Often times, a store will provide a wooden spoon or the like to the consumer but that requires effort by the store to ensure that the eating utensil is available and that the consumer finds the eating utensil without having to make a return trip to the store. It would be desirable to provide a container with its own eating utensil that is removably mounted to the container. Often times, for ice cream, a so called wooden spoon is provided but such spoon is typically flat on both major surfaces and while acceptable for consuming a solid or semi-solid material, they are practically useless for a product such as ice cream after it has melted some.

Typically, packaging is a low margin product and the attachment of an eating utensil to a package should be done in a manner that is amenable for high speed production and not result in any appreciable increase in the cost of the container to the food manufacturer. Because packaging equipment is expensive, it is often times been found desirable to manufacture container components at one facility and assemble them at another facility after filling. It is also desired that the final assembly of the filled containers be done with currently existing machinery at the food production plant. This eliminates the need for a new machine at each manufacturing facility and the attendant costs.

Thus, there is a need for an improved food container having its own eating utensil mounted thereto.

SUMMARY OF THE INVENTION

The present invention involves the provision of a food container having a storage cavity forming receptacle such as a cup with an opening to provide access to the stored contents. A multiple component lid is provided with the lid including an end cap that is mountable to the cup which mounting can be of an easily removable type or a semi-permanently mounted type. The lid also includes a cover that is receivable in a recess of the end cap and is releasably mounted thereto. An eating utensil is positioned between a wall of the end cap and the cover. Removal of the cover provides access to the eating utensil. The cover includes a notch extending inwardly from the outer periphery of the cover to allow a consumer to easily remove the cover from the end cap.

The present invention also involves the provision of a process for manufacturing a food container including a lid and container bottom. The container bottom is suitably formed. The lid includes an end cap that is made and removably mounted to the receptacle after the contents of the container are placed in the storage cavity of the container bottom. The end cap is formed to provide a depending skirt to help secure the lid to the cup. A recess is also formed in the end cap and has a bottom wall and a sidewall. The sidewall is provided with at least one member forming a shoulder generally facing toward the bottom wall of the recess. A cover is formed and is provided with the size and shape to fit within the recess of the end cap and to be captured between the shoulder forming member and the bottom wall providing a storage compartment for an eating utensil. Prior to mounting the cover to the end cap, an eating utensil, such as a spoon, is placed on the bottom wall and the cover mounted over the bottom wall and interposed eating utensil. The cover is formed from a sheet of material and is formed with an inwardly extending notch. During formation of the cover, the portion of material removed from one cover to form the notch is part of an adjacent cover. Such an arrangement permits additional covers to be formed from a sheet of material while providing an easily usable cover with a notch to facilitate removal of the cover from the end cap by a consumer.

BRIEF DESCRIPTION OF THE DRAWINGS

Like numbers throughout the various Figures designate like or similar parts and/or structure.

DETAILED DESCRIPTION

Figure 1:
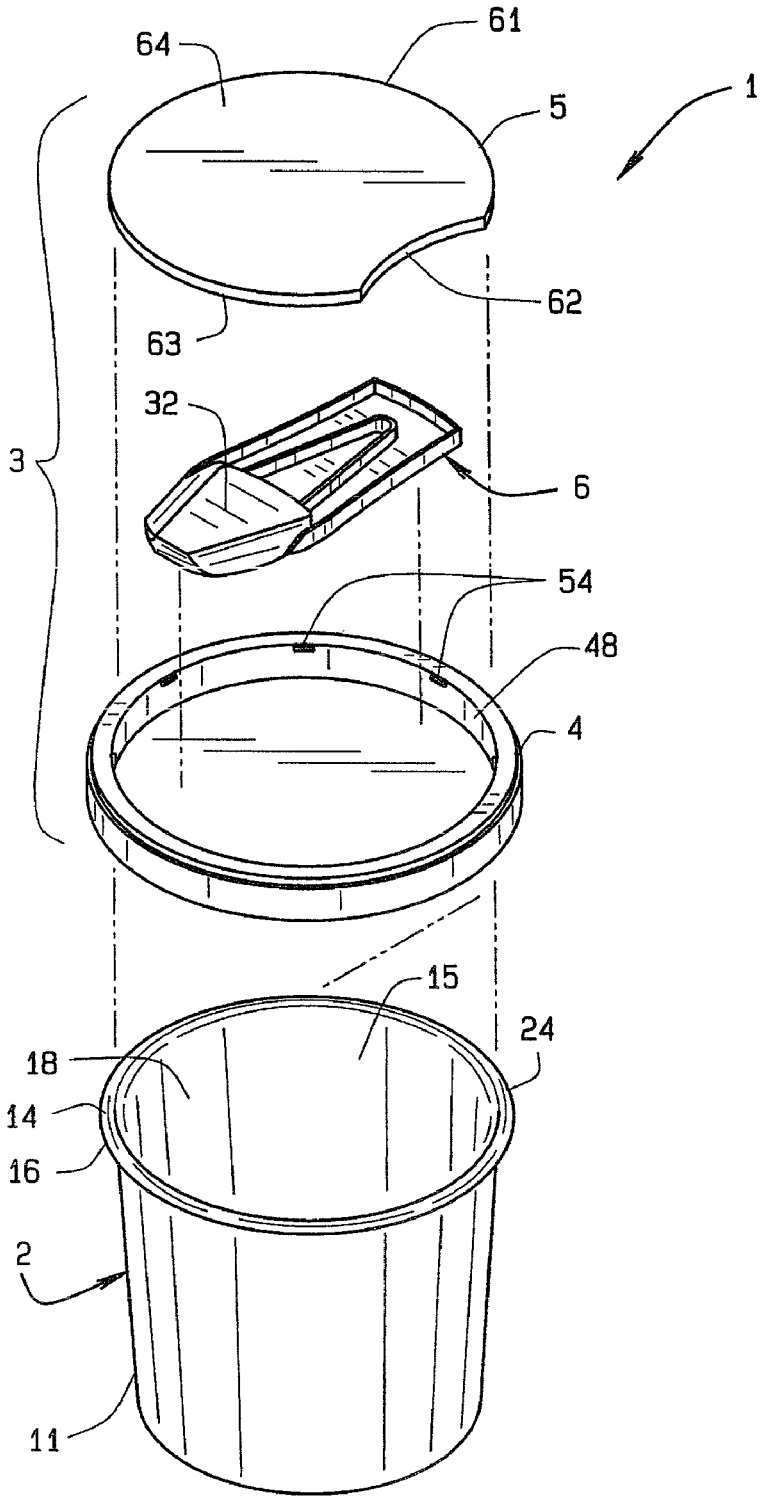
FIG. 1 is an exploded perspective view of the container of the present invention.

The reference numeral 1 designates generally a container comprising a container bottom or receptacle designated generally 2 and a lid designated generally 3. The lid 3 includes an end cap 4 and a cover 5 and carries an eating utensil or implement 6. As seen in FIG. 1, the container 1 can be associated with an overwrap designated generally 8.

The receptacle 2 is in the form of an upwardly opening cup having a sidewall 11, a bottom member 12 at a base portion 13 and an open mouth 14. The open mouth 14 includes an opening 15 defined about its perimeter by an upper lip portion 16 of the receptacle 2. The sidewall 11 and bottom wall 12 define a storage cavity or compartment 18 for the storage of a food product such as ice cream, yogurt, cereal, desserts or the like. The receptacle 2 may be suitably formed of a suitable material for example a coated paperboard in the event the contents will contain components that could migrate into the paperboard such liquids, e.g., water and/or lipids, e.g., fats and oils. The receptacle 2 may be a longitudinally side seamed wrapped paperboard having a bottom seal 20 with a depending skirt portion 21 of the bottom member 12. The sidewall 11 may be frustoconical or straight wailed. The seal can be formed by reverse bending a bottom portion of the sidewall 11 upwardly and attaching it to the skirt 21. Sealant may be provided at the junction between the bottom 12 and the sidewall 11 in the cavity 18. The receptacle 2 may also be thermoformed, vacuum formed or injection molded from a polymeric material if desired. An outwardly radially extending lip 24 may be provided adjacent the top 16 of the receptacle 2 to help in securing the lid 3 to the receptacle 2. Such receptacles 2 are well known in the art. The outside surface of the sidewall 11 may be provided with indicia such as the name of the product, the brand name, labeling information and other graphics and/or trade dress.

The lid 3 includes the end cap 4 and cover 5 and has an eating utensil 6 mounted thereto. The eating utensil 6 may be any suitable utensil and is shown as a spoon having a handle portion 31 and a receptacle portion defining a cavity 32. Preferably, the surface 33 that engages a bottom wall 37 of the end cap 4 is generally planar wherein the convex outer portion 39 of the receptacle 32 extends upwardly and away from the wall 37. The cover 5 overlies the convex portion 39 in the illustrated structure. The eating utensil 6 is preferably molded and is made from a polymeric material as is suitable for the particular type of product contained within the container 1.

Figure 2:
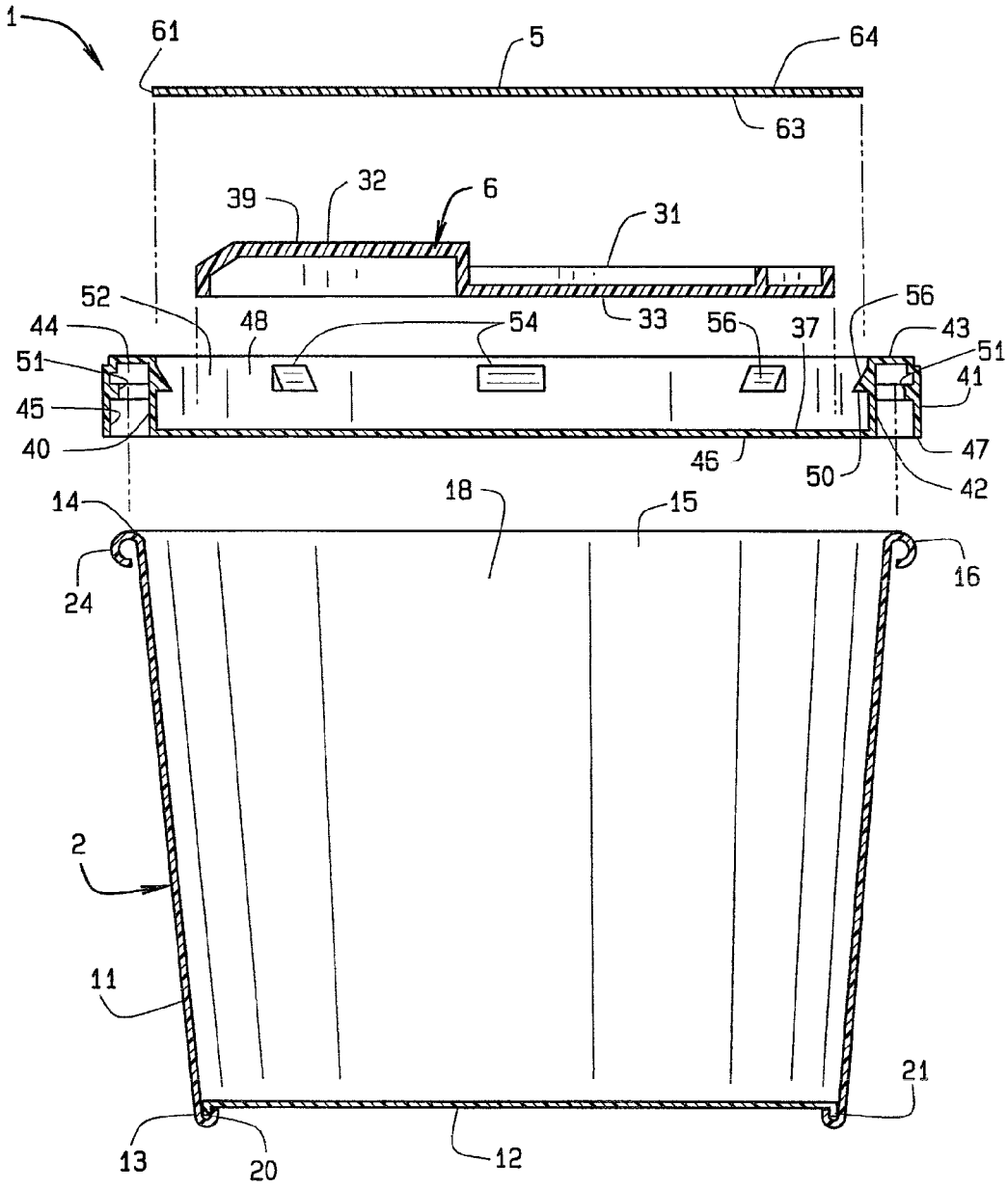
FIG. 2 is an exploded side sectional view of the container.
Figure 3:
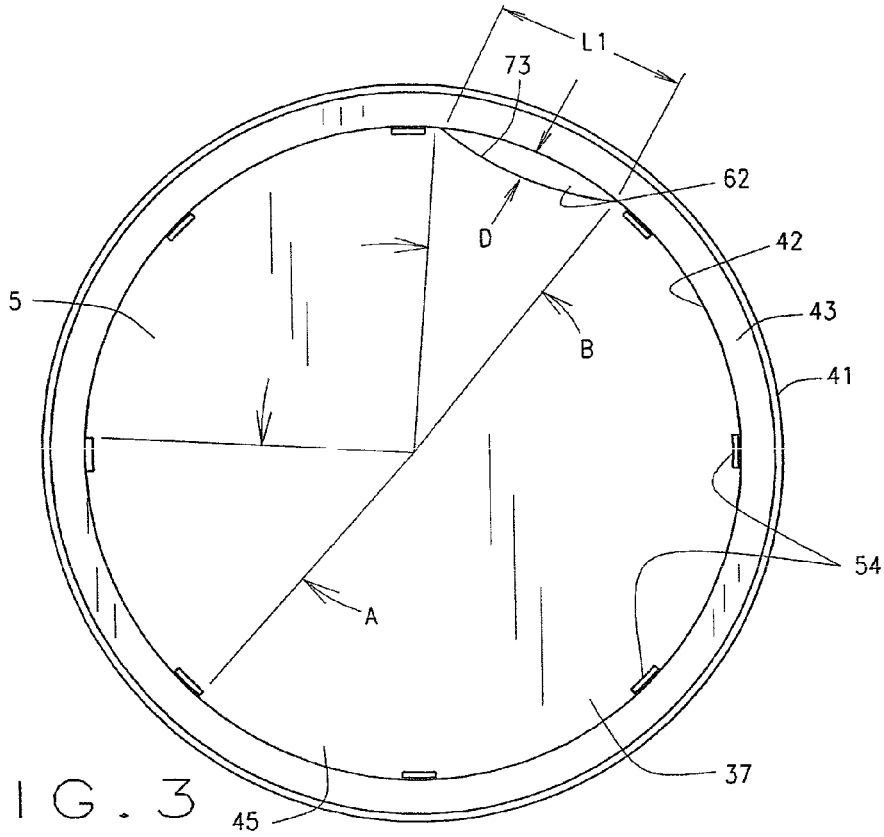
FIG. 3 is a top plan view of a lid with installed cover.

The end cap 4 is also preferably molded from a polymeric material. A preferred molding method is injection molding however, thermoforming or vacuum forming may also be used if desired. The end cap 4 includes a skirt 41 connected to a recess sidewall 42 by a bight portion 43. The inside surface 45 of the skirt 41 and outside surface 40 of sidewall 42 define a circumscribing groove 44 for receipt therein of the upper lip portion 16 and the peripherally extending rib 24. A shoulder forming member 51 may be provided on the inside surface of the skirt 41 to latch under the lip 24 to help secure the end cap 4 to the cup 2 if desired. The bottom wall 37 extends partially across the end cap 4 at the sidewall 42 partially forming an open top recess 52. In the illustrated structure, the bottom surface 46 of the bottom wall 37 generally lies in the plane of the bottom edge 47 of the skirt 41. The recess 52 has a top opening 48 defined by the sidewall 42. At least one shoulder forming member is provided and projects inwardly from the sidewall 42 to form at least one shoulder 50 facing toward the bottom wall 37. As shown, the at least one shoulder forming member includes a plurality of detents 54 extending generally radially inwardly from the sidewall 42 and are in peripherally spaced apart relationship as best seen in FIG. 1 and in FIG. 3. As seen in FIG. 2, the top surfaces 56 of the detents 54 are downwardly and inwardly inclined to facilitate installation of the cover 5. The detents 54 are separated by an arc angle A a distance as described below. The center to center spacing of the detents is preferably in the range of between about ½ inch to about 1½ inches. For example, the arc angel A would be on the order of about 10° to about 60° between outside side edges of adjacent detents 54 as best seen in FIG. 3 and will depend on the size of the cover 5. The recess 52 has depth determined by the thickness of the utensil 6 and can be on the order of ⅛ to ⅜ inches deep as measured from the top of the bight 43 to the inside surface of the bottom wall 37.

Figure 4:
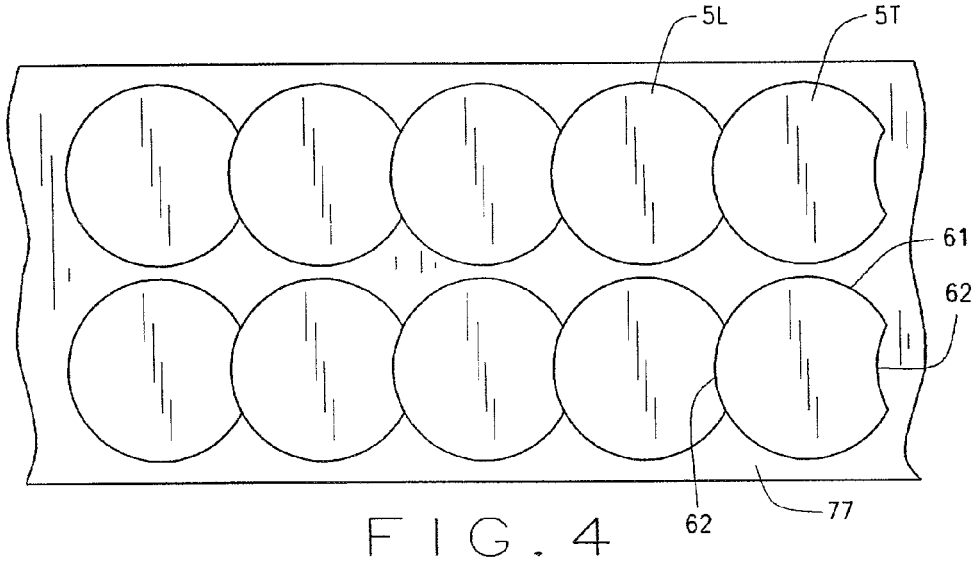
FIG. 4 is a schematic plan view of a series of covers as positioned for cutting from a strip of material.

The cover 5 may be made of any suitable material such as paperboard or a polymeric material. The cover 5 may be molded to shape or cut to shape as for example by die cutting, laser cutting or the like. A preferred cover 5 is made of paperboard and is on the order of about 0.01 inches to about 0.03 inches in thickness. The cover 5 has an outer peripheral edge 61 defining the perimeter side shape of the cover 5. The cover 5 includes a peripheral margin portion extending inwardly from the edge 61 forming an open sided notch 62. The cover 5 has a generally planar bottom surface 63 and an opposing generally parallel and planar outer or exposed surface 64. The perimeter of edge 61 is sized and shaped to be received within the recess 52 and be adjacent to the sidewall 42 and be received under the shoulders 50 for releasable securement within the recess 52. The notch 62 extends inwardly from the outer edge 61 a distance D on the order of about ⅛ inch to about ½ inch and is adequate to provide access by a consumer to the underneath side of the cover 5 to facilitate removal of the cover 5 from its releasable mounting to the end cap 4, as for example, by placing a fingernail under the cover 5 and lifting to resiliently deform the cover 5 allowing it to be removed from under the one or more shoulders 50. The outer edge 61 is sized and shaped to fit within the recess 52 and is shown as generally circular except for at the notch 62. However, other shapes could be utilized if desired, as for example, a hexagonal or oval shape to match the contour of the sidewall 42. In a preferred embodiment, the cover 5 is generally circular and the shape of the edge 73 forming the notch 62 generally corresponds to the shape of the outer edge 61. As best seen in FIG. 4, in the manufacturing process, a sheet 77 of material is provided that will allow one or more rows of covers 5 to be cut therefrom. A trailing cover 5T is cut from the sheet 77 such that its leading edge LE is removed from a portion of the leading cover 5L. It is noted that a trailing cover 5T is also a leading cover 5L. It has been found that by utilizing this notch cutting technique an increase in the yield amount of about 10% can be realized for a given length of sheet of material. Thus, the contour of the outer edge 61 of the cover 5 corresponds substantially to the contour of the edge 73. When both are round, the outer edge 61 is round and the edge 73 has a corresponding radius to the radius of the preceding cover 5. The arc angle B as seen in FIG. 3 between opposite ends of the notch 62 is preferably substantially equal to and can be slightly more than the arc angle A. It is preferred that no more than two detents 54 be encompassed within a notch 62 when the cover 5 is installed on the end cap 4. The about length L1 of the notch is preferably in the range of between about ½ inch and about 1½ inches with about 1 inch having been found acceptable. The edge 61 and edge 73 have corresponding shapes that are preferably circular with substantially the same radius of curvature.

When assembled, the lid 1 has an eating utensil 6 retained within the recess 52 and releasably retained in position, by the cover 5 being latched under the detents 54 wherein the outer surface 64 engages the shoulders 50 of the detents 54. The spacing between the shoulders 50 and the inner surface of the bottom wall 37 is preferably substantially equal to or greater than the thickness T of the eating utensil 6 plus the thickness of the cover 5. The cover 5, may also be provided with indicia such as packaging graphics, advertising materials, brand name, a product description and the like.

Figure 5:
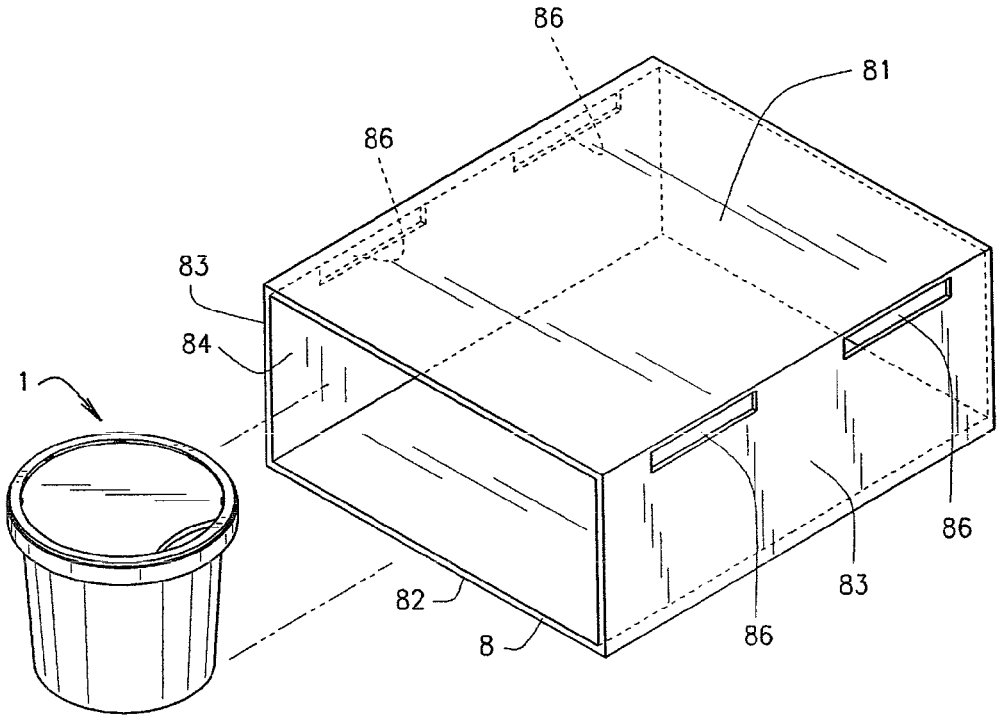
FIG. 5 is a perspective view of one form of a container overwrap for a multi-unit package.
Figure 6:
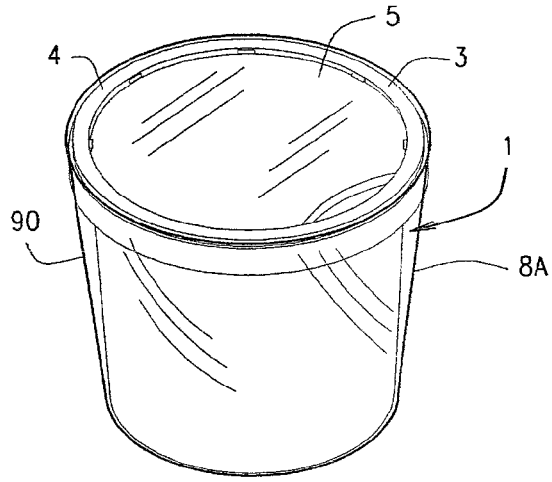
FIG. 6 is a perspective view of a second form of container overwrap for a singles pack.

As best seen in FIGS. 5, 6 two forms overwrap 8 are shown. The overwrap 8 in FIG. 5 may be a paperboard or chip board outer container having a top wall 81 bottom wall, 82 and sidewalls 83 forming a storage space 84 within which a plurality of containers 1, for example four in the illustrated embodiment, can be secured and held in place by portions of the lid 3 of each container engaging edges of a respective slot 86. The packaging graphics may also be provided on the overwrap. The overwrap 8A may be a shrink wrap film 90 (FIG. 6) that provides security and tamper evidence.

The present invention is better understood by a description of the method of manufacture. The receptacles 2 may be suitable formed as by molding or by suitably wrapping paperboard. Generally, the receptacles 2 are made in a facility separate from the food manufacturing area as for example at a separate manufacturing facility. The receptacles 2 are fed along a filling line and product is deposited within the cavities 18. Generally, the product is deposited by weight in a suitable manner. The filled receptacles 2, either prior to attaching a respective lid 1 or after attaching a lid 1, will be typically transported through a metal detector to determine the presence or absence of metal and if metal is present the container 1 with its contents are rejected. After depositing of the contents, the lid 3 in its assembled condition, the utensil 6 being retained by a cover 5, is placed over the mouth 14 and the lid 3 pressed into a mounting engagement with the receptacle 2. Prior to assembling the container 1, the lid 3 is assembled. It is preferred, that the lid 3 be assembled at the container manufacturing facility with its three main components, the end cap 4, eating utensil 6 and cover 5 being pre-assembled. Prior to assembling the lid 3, the end cap 4 is suitably formed as by injection molding or thermoforming or vacuum forming. Preferably, the end cap 4 is injection molded wherein the exterior surface of the skirt 41 is generally cylindrical as is the sidewall 42. The detents 54 are formed during the molding process. The end cap 4 is thus preferably an integrally molded single piece unit. The covers 5 are formed from a sheet of material and may be die cut or otherwise suitably cut from a sheet of material. The edges 61 are formed by the cutter as are the notches 62. The edge 73 of a notch 62 corresponds to an edge 61 of an immediately adjacent cover 5 allowing more covers 5 to be cut from a given length of sheet of material in proportion to the depth D of the notch from a continuation of the edge 61 contour across the notch 62. An eating utensil is placed in the recess 52 preferably flat side down. The cover 5 is then positioned over the recess 52 and pressed into position wherein the outer surface 62 is captured under the shoulders 50 releasably securing the eating utensil 5 within the recess 52. The thus assembled lid is then mounted to the filled container at the food manufacturing plant after the receptacle 2 is filled with food product.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A food container with an eating implement, said container comprising:

a receptacle with a storage cavity, said receptacle having a sidewall and an opening defined by a lip perimeter;

an end cap removably mounted to the receptacle and covering the opening, said end cap having an outwardly opening recess with a bottom wall extending generally across the opening and at least one shoulder forming member projecting into the recess and extending about an outer perimeter of the recess, said at least one shoulder forming member having a shoulder spaced from the bottom wall;

a cover removably mounted to the end cap and fitting within the recess, said cover having a peripheral edge and an inwardly extending notch opening at the peripheral edge providing access to an underneath side of the cover prior to the removal of any portion of the cover from the end cap recess, said cover being releasably captured between the shoulder and bottom wall; and an eating implement releasably retained between the cover and bottom wall.

2. The container as set forth in claim 1 wherein the notch being defined by a first edge with a shape corresponding to a peripheral second edge of the cover such that when at least two covers are cut from a single sheet of material a portion of the peripheral edge of one cover forms the notch of an ad adjacent cover and said at least one shoulder forming member including a plurality of detents spaced apart about the outer perimeter of the recess and each having a said shoulder.

3. The container as set forth in claim 2 wherein the first and second edges being generally circular and having substantially the same radius of curvature.

4. The container as set forth in claim 3 wherein the eating implement including a spoon.

5. The container as set forth in claim 4 wherein the spoon including a cavity on one side and a generally planar surface portion engaging the bottom wall.

6. The container as set forth in claim 4 wherein the end cap including a skirt with a generally cylindrical outer surface.

7. The container as set forth in claim 2 wherein the notch extends through an arc angle of less than about an arc angle between adjacent said detents such that no more than two detents can be located between opposite ends of the notch.

8. A food container with an eating implement, said container comprising:

a receptacle with a storage cavity, said receptacle having a first sidewall portion, a first bottom wall portion and a top opening defined by a lip perimeter;

an end cap removably mounted to the receptacle and covering the opening, said end cap having an outwardly opening recess with a second bottom wall portion and a second sidewall portion, said second bottom wall portion extending generally across the top opening, said end cap including at least one member on the second sidewall projecting inwardly therefrom and forming a shoulder spaced from the second bottom wall portion;

a cover positioned in the recess and having an outer peripheral portion adapted to engage said shoulder being removably captured between the shoulder and the second bottom wall, said cover having a peripheral edge with a notch extending inwardly therefrom providing access to an underneath side of the cover prior to the removal of any portion of the cover from the end cap recess, said notch being defined by a first edge corresponding generally in shape to a portion of the peripheral edge; and an eating implement releasably retained between the cover and second bottom wall portion.

9. A lid for a container, said lid including:

an end cap having an outwardly opening recess with a bottom wall portion and a sidewall portion, said bottom wall portion configured for extending generally across a top opening of said container, said end cap including at least one member on the sidewall portion projecting inwardly therefrom and forming a shoulder spaced from the bottom wall portion;

a cover positioned in the recess and having an outer peripheral portion adapted to engage said shoulder and is removably captured between the shoulder and the bottom wall, said cover having a peripheral edge with a notch extending inwardly therefrom providing access to an underneath side of the cover prior to the removal of any portion of the cover from the end cap recess, said notch being defined by a first edge corresponding generally in shape to a portion of the peripheral edge; and an eating implement releasably retained between the cover and second bottom wall portion.

10. The container as set forth in claim 1 wherein the space between the shoulder and the bottom wall is substantially equal to or greater than a combined thickness of the eating implement and the cover.

11. The container as set forth in claim 1 wherein the peripheral edge of the cover is generally circular and the notch opening is formed by an arc-shaped cut having a radius substantially equal to a radius of the peripheral edge of the cover such that when at least two covers are cut from a single sheet of material a portion of the peripheral edge of one cover forms the notch opening of an adjacent cover.

12. The container as set forth in claim 1 wherein the eating implement is a spoon that includes generally planar top and bottom surfaces and a thickness allowing it to be releasably retained in position between said bottom wall and cover.

13. The container as set forth in claim 1 wherein the cover consists essentially of a generally planar element.

14. The container as set forth in claim 9 wherein the space between the shoulder and the bottom wall is substantially equal to or greater than a combined thickness of the eating implement and the cover.

15. The lid as set forth in claim 9 wherein the peripheral edge of the cover is generally circular and the first edge of the notch is generally arc-shaped and has a radius substantially equal to a radius of the peripheral edge such that when at least two covers are cut from a single sheet of material a portion of the peripheral edge of one cover forms the notch opening of an adjacent cover.

16. The lid as set forth in claim 9 wherein the eating implement is a spoon that includes generally planar top and bottom surfaces and a thickness allowing it to be releasably retained in position between said bottom wall and cover.

17. The container as set forth in claim 12 wherein the spoon includes a convex receptacle portion having generally planar top and bottom surfaces to allow the spoon to compactly fit between the end cap bottom wall and the cover.

* * * * *